US005314170A

United States Patent [19]

Tada et al.

[11] Patent Number: 5,314,170

[45] Date of Patent: May 24, 1994

[54] STEEL HEATING FURNACE

[75] Inventors: Takeshi Tada; Toshikazu Akiyama, both of Tokyo; Ryoichi Tanaka; Masao Kawamoto, both of Yokohama, all of Japan

[73] Assignees: Nippon Furnace Kogyo Kaisha, Ltd., Kanagawa; NKK Corporation, Tokyo, both of Japan

[21] Appl. No.: 967,101

[22] Filed: Oct. 27, 1992

[30] Foreign Application Priority Data

Oct. 31, 1991 [JP] Japan ..... 3-311563

[51] Int. Cl.[5] ..... F27B 9/36

[52] U.S. Cl. ..... 266/156; 266/252; 432/180

[58] Field of Search ..... 266/249, 252, 156; 432/133, 180, 181, 182

[56] References Cited

U.S. PATENT DOCUMENTS

| | | | |
|---|---|---|---|
| 478,767 | 7/1892 | Smythe | 432/182 |
| 3,374,995 | 3/1968 | Cook, Jr. | 432/133 |
| 4,022,571 | 5/1977 | Gentry et al. | 432/180 |

FOREIGN PATENT DOCUMENTS

| | | |
|---|---|---|
| 0701315 | 12/1953 | United Kingdom . |
| 1195374 | 6/1970 | United Kingdom . |
| 1367073 | 9/1974 | United Kingdom . |
| 1495190 | 12/1977 | United Kingdom . |
| 2224563A | 9/1990 | United Kingdom . |

*Primary Examiner*—Scott Kastler
*Attorney, Agent, or Firm*—Notaro & Michalos

[57] ABSTRACT

The present invention relates to a steel heating furnace which permits free setting of an in-furnace temperature pattern or gradient as desired. A steel heating furnace 1 includes at least one or more burner systems of regenerative heating, each being arranged to supply a combustion air and exhaust a combustion gas through a regenerative bed. Those burner systems are disposed in each of plural zones which are defined within a single furnace body, or in each of unit furnaces 2. The unit furnaces 2 are interconnected to form a single furnace body. The amount of combustion may be controlled for each zones or each unit furnaces 2 to enable free variation of in-furnace temperature per zone or per unit furnace 2 so that a desired in-furnace temperature pattern gradient in the entire furnace 1 may be set easily. The steel heating furnace 1 may be constructed with a required length and in-furnace temperature pattern, by interconnecting the unit furnaces.

20 Claims, 4 Drawing Sheets

STEEL HEATING FURNACE

FIELD OF THE INVENTION

The present invention relates to a steel heating furnace. More specifically, the present invention relates to a steel heating furnace in which an in-furnace temperature pattern can freely be controlled.

DESCRIPTION OF PRIOR ART

An ordinary continuous steel heating furnaces in the prior art is arranged, as shown in FIG. 6, such that the inside of the furnace is partitioned into plural zones, i.e., four zones 101, 102, 103 and 104, or as may be required, six zones, each of them having a heating burner 105 installed therein. At each zone, a pair of upper and lower burners 105, 105 are disposed vertically relative to a workpiece or steel W to be heated, and oriented to spread flames alongside the workpiece W, while flowing a combustion gas toward a smokestack 107, without contact of the flames upon the heated workpiece. The smokestack 107 is provided at an entry opening 106 through which the workpiece is carried into the furnace. Thus, in the upstream zones near to an exit opening 108, through which the workpiece is carried out of the furnace, the combustion gas is introduced in success towards the downstream zones, passing through the zones in the order of 101, 102, 103, 104 and then, exhausted out in the neighborhood of the last zone 104. This arrangement, to a certain degree, helps to keep constant a given temperature distribution in the furnace along the longitudinal direction thereof.

However, in operation, it has been found that, during the flow of combustion gases in the furnace, one gas is successively added to another gas from the downstream zones to the upstream zones towards the smokestack 107, which encounters a difficulty in setting and maintaining a desired temperature in each zone (101, 102, . . . ). For, a difficulty does exist in evaluating an influence of the upstream zone combustion upon the downstream one. Namely, it is hard to determine an effect of the combustion gases in the upstream zones which are being added to the combustion gases in the downstream zones. Moreover, this inevitably results in the upstream-zone combustions affecting a temperature pattern or gradient set within the furnace, and therefore, setting such in-furnace temperature pattern or gradient at a desired condition can hardly be made in each zone in the direction of the flow of combustion gases, hence making impossible a free setting of the in-furnace temperature pattern or gradient, as a consequence of which, an operator is forced to set a limited curve of temperature increase in this sort of continuous heating furnace system.

SUMMARY OF THE INVENTION

The purpose of this invention is to provide a steel heating furnace which permits free setting of an in-furnace temperature pattern therein.

To achieve the above purpose, a steel heating furnace, in accordance with the present invention comprises, at least one burner system of a regenerative heating type which is provided at each of said plurality of zones, the burner system including a regenerative bed and a burner means, a combustion air supply means for supplying a combustion air via the regenerative bed to the burner means, and a combustion gas exhaust means for exhausting a combustion gas via the regenerative bed from the burner means, wherein a temperature in each of the plurality of zones may be controlled as desired. Accordingly, most of the combustion gas generated in each zone is exhausted externally through the regenerative bed and will not substantially flow into the other adjacent zones.

Further, in accordance with the invention the steel heating furnace may comprise one furnace body, an entry opening defined in said furnace body, through which a workpiece or steel is carried into the furnace, an exit opening defined in the furnace body, through which the workpiece or steel is carried out of the furnace, the furnace body including a plurality of unit furnaces, at least one burner system of a regenerative heating type which is provided at each of said plurality of unit furnaces, the burner system including a regenerative bed and burner means, a combustion air supply means for supplying a combustion air via the regenerative bed to the burner means, and a combustion gas exhaust means for exhausting a combustion gas via the regenerative bed from the burner means, wherein the plurality of unit furnaces are interconnected to form the one furnace body.

Strictly stated, although the combustion gas generated in one zone or unit furnace and the combustion gas generated in the other adjacent zones or unit furnaces are mixed with one another at their interfaces to some extent, yet a large part of combustion gas is directly exhausted from each zone or unit furnace and therefore will not affect temperature distribution in the other adjacent zones or unit furnaces. Consequently, adjusting an amount of combustion in each zone or unit furnace changes each in-furnace temperature therein, independently. Since such in-furnace temperature change takes place within only each zone or unit furnace and will not impose an effect upon the same change in other adjacent zones or unit furnaces. Accordingly, to control the amount of combustion for each zone or unit furnace will not only lead to temperature setting thereof independent of each other, but also to the setting of an in-furnace temperature pattern in the entire steel heating furnace, so that, for instance, such an in-furnace temperature pattern as shown in FIG. 2, can be obtained. It is thus possible to set a free heat flux pattern, achieve a proper heating of both hot and cold workpieces in the same furnace, and further recover an exhaust heat with high efficiency at a higher loading temperature of hot workpieces. Furthermore, by alternately bringing the burners into combustion for a short period of time, a temperature distribution in each zone or unit furnace may be made even, which improves the quality of a heated workpiece or steel. Still further, by virtue of the regenerative bed, a high-temperature air close to the temperature of the combustion exhaust gas is obtained, making it possible to largely reduce the amount of fuel and raise the combustion temperature at further degrees.

The burner systems of heat accumulation type each preferably comprises two units of regenerative beds and burners, as a pair, integrally assembled for each unit and the burners in the two units are alternately brought into combustion for a short period of time. More preferably, such burner systems may include at least a pair of first burners and at least a pair of second burners such that said pair of first and second burners are each disposed in a spaced-apart and opposed relation with other.

Preferably, each of the zones or unit furnaces is provided with a furnace pressure control device for adjustment of the in-furnace pressure as may be required.

The steel heating furnace in the present invention is also featured in that a temperature in the zone or unit furnace nearer to the workpiece carry-in side is controlled to be higher than a temperature in the same nearer to the workpiece carry-out side. This allows a temperature rising speed of the heated workpiece to be accelerated, whereby an overall length of the furnace may be reduced. The reduced furnace length contributes to a reduction not only in the cost of equipment but also in the space to be occupied.

Additionally, where a single furnace is constituted by interconnecting the above mentioned plural unit furnaces, the steel heating furnace can be constructed in a required length, while having a required in-furnace temperature pattern.

In another aspect of the invention, it may be arranged such that at least one burner is provided in the burner system and a means is included therein, which causes the regenerative bed to be displaced with respect to a flow of the combustion air and gas towards the burner.

DETAILED DESCRIPTION OF PREFERRED EMBODIMENTS OF THE INVENTION

Figure 1:
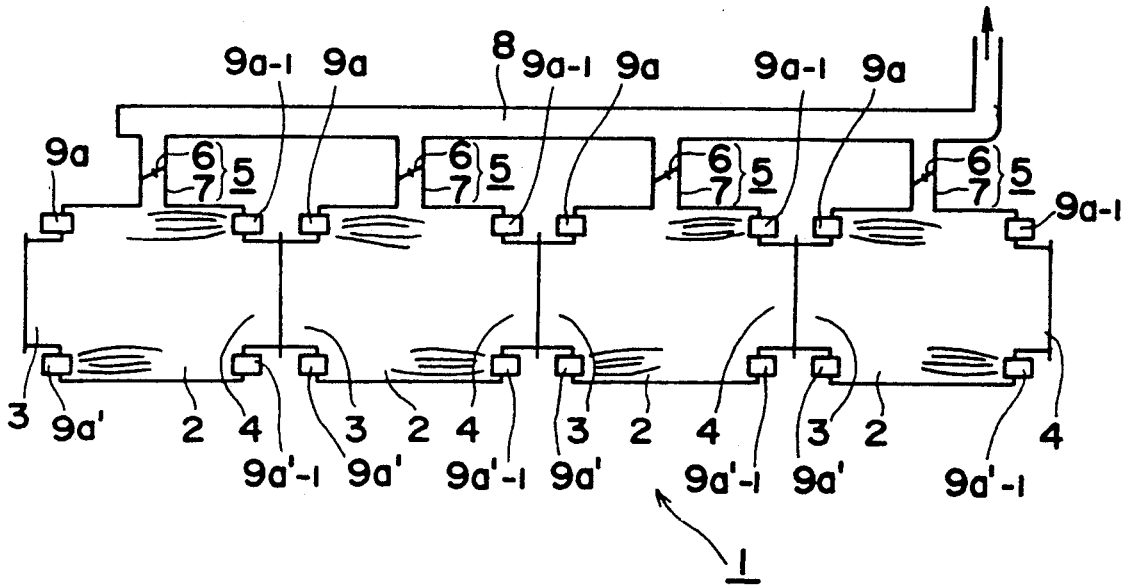
FIG. 1 is a schematic principle view showing one embodiment of a steel heating furnace in accordance with the present invention.
Figure 2:
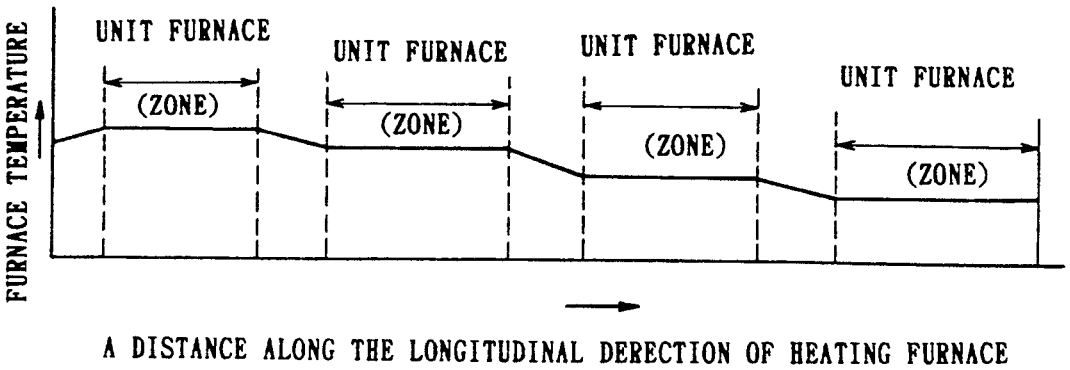
FIG. 2 is a representation showing one example of an in-furnace temperature pattern in accordance with the steel heating furnace of the present invention.

Now, referring to the embodiments shown in the drawings, a specific description will be made of the present invention.

FIG. 1 shows one embodiment of a steel heating furnace in accordance with the invention. A steel heating furnace 1 comprises a plurality of box-shaped unit furnaces 2 which form interconnected temperature zones and which together form one steel heating furnace as a whole. Each unit furnace 2 is provided with an entry opening 3 at one side thereof, through which opening, a workpiece or steel W to be heated is carried to enter the unit furnace, and an exit opening 4 at another opposite side thereof, through which opening, the workpiece W is carried out of the unit furnace (see FIG. 3). Hence, all the unit furnaces 2 are jointed together at those two openings 3 and 4 in an integral manner, to thereby assume the shown one furnace configuration.

Designation 5 denotes a furnace pressure control device disposed at the ceiling portion of each unit furnace 2. The furnace pressure control device 5 is comprised of a duct 7 fixed on the ceiling portion of the unit furnace 2, and a damper 6 in the duct 7. The damper 6 is journalled rotatably within the duct 7 for opening and closing the latter, whereby the damper 6 may be adjustably rotated for controlling the degree of opening the duct 7 in order to adjust an amount of a combustion gas to be exhausted from the unit furnace 2 or adjust an amount of a combustion air to be sucked thereinto. All the devices 5 are coupled to a collective smokestack 8. Thus, depending on the circumstances and conditions, the in-furnace pressure may be controlled to a desired degree by operation of the device 5. If required, the duct 7 may include a fan (not shown) to perform an induced exhaust, or may be coupled to a smokestack for causing a tunnel effect to exhaust the combustion gas and air. This control device 5 may be disposed at any other suitable location than the ceiling portion of unit furnace 2.

Figure 3:
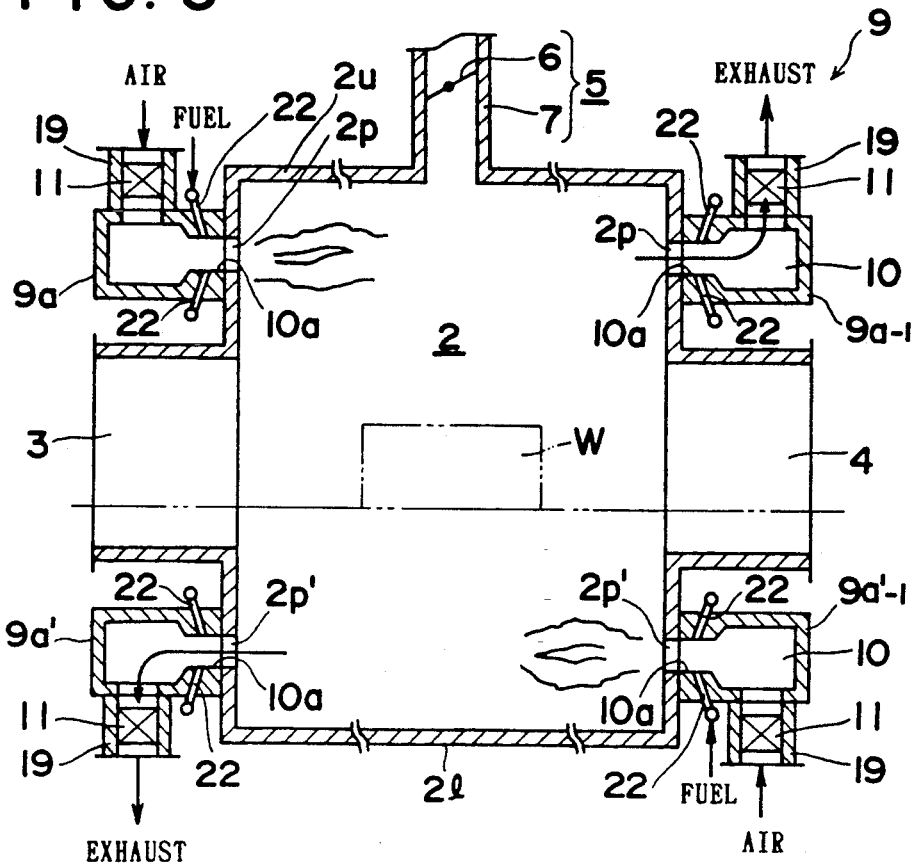
FIG. 3 is a schematic sectional view of a unit furnace.
Figure 4:
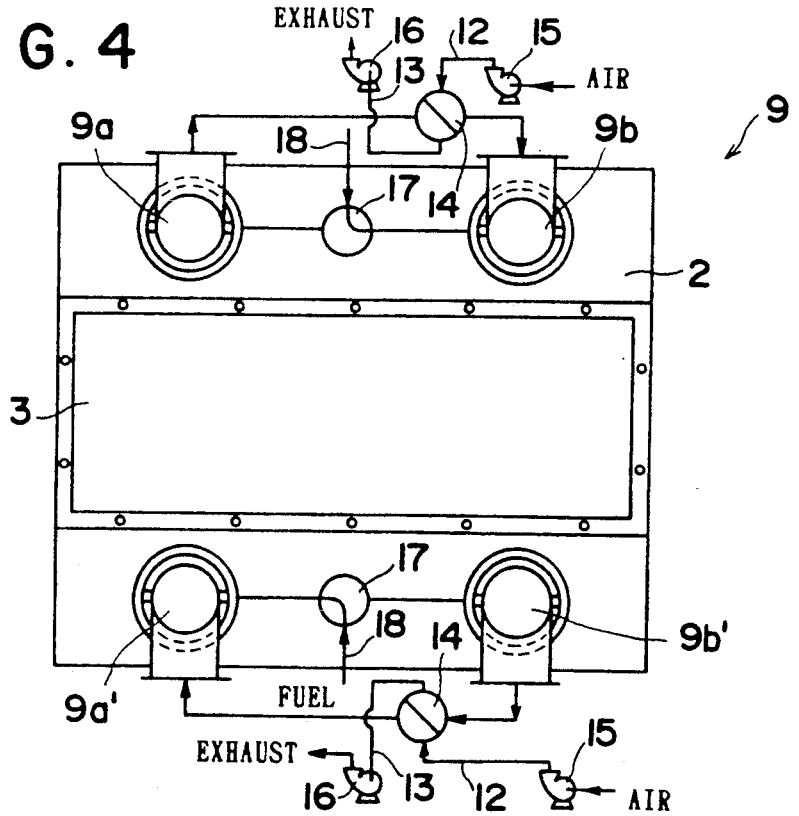
FIG. 4 is a schematic view showing one embodiment of a burner system of regenerative heating type in the unit furnace.

According to the invention, the furnace 1 is provided with one mode of burner system having a regenerative bed, as generally designated at 9. Namely, as viewed from 3, each unit furnace 2 has a pair of upper forward and backward burners **9*a*, 9*a*-1, disposed at the upper side (top wall) 2*u* thereof in an opposed and spaced-apart relation with each other, and a pair of lower forward and backward burners 9*a*', 9*a*'-1 disposed at the lower side (lower wall) 2*d* thereof, which are also in a mutually opposed and spaced-apart relation. Further, as can be seen in FIGS. 4 and 3, the upper burners and lower burners are in pairs. Further, as can be seen in FIG. 4 in conjunction with FIG. 3, the foregoing pair of upper burners 9*a*, 9*a*-1 and pair of lower burners 9*a*', 9*a*'-1, a respectively provided two in number, whereupon there are arranged two pairs of upper burners, as indicated by 9*a*, 9*b*, and two pairs of lower burners, as indicated by 9*a*', 9*b*', within the unit furnace 2, such that the former (9*a*, 9*b*) and latter (9*a*', 9*b*') are respectively situated above and below the workpiece W to be heated thereby. Though not shown, the workpiece W is placed on a feed belt for transfer through the furnace 1**.

The upper and lower burners **9*a*, 9*a*-1, 9*a*', 9*a*'-1, each comprises a burner body 10 and a duct 19, both of which are connected together. The burner body 10 is hollow therein, having a burner throat 10*a* at which are fixed plural combustion nozzles 22. As shown in FIG. 3, the burner throat 10*a* is aligned and communicated with a hole 2*p* formed in the unit furnace 2. The duct 19 has a regenerative bed 11 built therein. Accordingly, each burner 9*a*, 9*a*-1, . . . is of a regenerative heating type using the regenerative bed 11 in combination with the burner body 10**.

As will be explained later, one of those two opposingly faced upper burners **9*a* and 9*a*-1 is alternately operated to emit a generally horizontal flame alongside yet apart from the workpiece W. The same is done for the pair of lower burners 9*a*' and 9*a*'-1. Otherwise stated, with regard to the paired upper burners 9*a* and 9*a*-1, one of them effects a combustion, while another of them is inoperative for the combustion, with the combustion being effected alternately therebetween, during which, the inoperative burner works to exhaust a combustion gas through the burner body 10 and regenerative bed 11. This is also effected in the lower paired burners 9*a*', 9*a*'-1. For that purpose, as shown in FIGS. 3 and 4, there are provided a combustion air supply system 12 and a combustion gas exhaust system 13. The former system 12 is adapted to supply a combustion air into the burner body 10 via the regenerative bed 11, and the latter system 13** is to exhaust a combustion gas therefrom.

Although not clearly shown, but as understandable from FIGS. 4 and 3, there are plural sets of those systems 12 and 13 arranged on the opposite sides of the unit furnace 2, such that, as viewed from FIG. 4, one set of the systems 12, 13 is selectively connectable to upper forward burners 9a, 9b, and also another set of them is selectively connectable to the lower forward burners 9a', 9b'. Likewise, it is to be understood in conjunction with FIG. 3 that, on the other side of the unit furnace 2, one set of the systems 12 and 13 is selectively connectable to the two upper backward burners (at 9a-1), and another set of the same is selectively connectable to the lower backward burners (at 9a'-1). In each set of the systems 12, 13, a proper tubing is arranged as indicated in FIG. 4 to establish the above-stated selective connection relation between the adjoining two upper forward burners 9a, 9b and their corresponding set of the systems 12, 13, as well as between the lower two adjoining forward burners 9a', 9b' and their corresponding set of the systems 12, 13. This arrangement is also applied to the other side of unit furnace 2, as viewed from FIG. 4, which lies at the exit opening 4 and at which there are disposed the upper two adjoining backward burners (at 9a-1) and the lower two adjoining backward burners (at 9a'-1) as can readily be understood from FIG. 3. As can be appreciated, the tubing itself is only connected with the two adjoining burners at each side of unit furnace 2, which implies that there is no need to bridge the tubing over the unit furnace 2 in the longitudinal direction thereof to communicate together the pair of forward and backward burners (such as 9a and 9a-1, 9a' and 9a'-1 . . . ) for the same alternating burner operations. Thus, a short tubing material can be used, thus rendering lower the costs involved and further avoiding an excessive occupation of the tubing over the surrounding space.

In this regard, a specific explanation will be made only as to the pair of upper forward and backward burners 9a, 9a-1 located at the upper side 2u of unit furnace 2, for the sake of simplicity, in view of all the paired burners 9a, 9b, 9a' . . . being structurally identical to one another.

Both combustion air supply and combustion gas exhaust systems 12 and 13 are in a flow communication, via a four-way valve 14, with the respective burner bodies 10 of the two upper burners 9a, 9a-1, the four-way valve 14 being further connected with a forced draft fan 15 and an induced draft fan 16. Operation of the four-way valve 14 switches over the flow of combustion air and gas with respect to the burners 9, in cooperation with those two fans 15 and 16. With these systems, as can be seen in FIG. 4, a combustion air may be supplied by the forced draft fan 15 from the combustion air supply system 12 into the right-side burner 9a, while at the same time a combustion gas be exhausted by the induced draft fan 16 from the left-side burner 9b to the external atmosphere via the combustion gas exhaust system 13, or vice versa. A three-way valve 17 is disposed between and coupled to the right-side and left-side burners 9a, 9b. A fuel supply system 18 is selectively connectable by the three-way valve 17 to one of the two burners 9a, 9b so as to supply a fuel to the burner nozzles 22 therein, to thereby effect the combustion at the corresponding one of the two burners 9a, 9b. In the present case, the three-way valve 17 is controlled to connect the fuel supply system 18 with the right-side burner 9a for combustion with an air supplied from the combustion air supply system 12 to emit a flame from the right-side burner 9a (as in FIG. 3).

The regenerative bed 11 may preferably be formed from a cylindrical body having plural honeycomb-like cellular bores therein, which is made of a material with a relatively small pressure loss, yet with a great heat capacity and high durability, such as a fine ceramics. However, this is not limitative, but any other suitable material and structure may be employed therefor.

Although not shown, the present burner system is equipped with such accessories as a pilot burner and an ignition transformer, as is usual with this sort of burner system. Further, it may be arranged that a steam or water will be injected, if required, into a suitable line of the combustion air supply system 12, with a view to reducing NOx emission which will occur during the preheating of combustion air through the regenerative bed 11.

In this particular embodiment, the upper forward and backward burners 9a, 9a-1 are aligned on the same plane at the top wall 2u of unit furnace 2, and likewise aligned are the lower forward and backward burners 9a', 9a'-1 on the same plane at the lower wall 2d of same furnace 2. Therefore, a fuel and a combustion air are selectively supplied to one of the pair of upper spaced-apart burners 9a, 9a-1, while the same selective operation is being done for one of the lower paired burners 9a', 9a'-1. For instance, as shown in FIG. 3, when a combustion air is introduced by the forced draft fan 15 from the supply system 12 into the upper forward burner 9a, the nozzles 22 in that burner 9a ignite the air to create a flame, generally horizontally, in a direction towards the opposed hole 2b, while on the other hand, a combustion gas generated thereby is sucked into the opposed inoperative upper backward burner 9a-1 by means of the induced draft fan 16, for the exhaust purpose. At this point, the exhaust combustion gas passes through the regenerative bed 11, whereby a heat of the gas is recovered by the bed 11. The recovered heat is utilized to preheat a combustion air at a subsequent step where the inoperative burner 9a-1 is brought in an operative state by the above-stated alternating changeover operation of four-way and three-way valves 14, 17. Namely, the exhaust combustion gas being forced out from the upper backward burner 9a-1 is utilized for absorption of its heat by the regenerative bed 11, and when the associated four-way and three-way valves 14, 17 (which are disposed at both opposite sides of unit furnace 2, although not shown but this will be understandable from FIGS. 3 and 4 as well as the previous description on the dispositions of plural sets of combustion air supply and combustion gas exhaust systems 12, 13) are switched over to direct the flow of combustion air and fuel towards the upper backward burner 9a-1, then it will be seen that such combustion air flowed into the burner 9a-1 is preheated by the regenerative bed 11 which absorbed and stores the heat of the foregoing first combustion exhaust gas.

With the arrangement explained above, the paired upper burners 9a, 9a-1 are alternately brought in operation for effecting the combustion or in an inoperative state for sucking the combustion gas, such that the flame and combustion gas are emitted from the operative burner body 10, flowing generally in parallel with the heated workpiece W, and then sucked into the other opposite burner body 10 which is in the inoperative state, for exhaust out of the furnace 2. This insures to exhaust a large part of the combustion gas generated in each unit furnace 2 to the outside of the furnace, thus preventing overflow of the gas to the other adjoining unit furnaces 2. The regenerative bed 11 recovers an exhaust heat of the combustion gas being exhausted from the non-operated burner in order to use the recovered heat for preheating a combustion air to be supplied into the same burner when the above-explained alternation of burner operation takes place to make it operative for combustion. In this regard, the burner thus in operation will rapidly burn a fuel due to the preheated combustion air, since the fuel is burned by the preheated air at a high temperature close to that of the exhaust gas. Hence, the burner systems in the present invention requires a quite less amount of fuel for the combustion. Another advantage of such preheating system is to enable an easy, stable control of the combustion temperature at any various degrees, even with such small amount of fuel, because, in the normal combustion case at a high degree of temperature, say, about 1,000° C., the regenerative bed 11 will preheat the combustion air at a degree close to that 1,000° C., enabling a quick ignition and combustion of the air even with small amount of fuel, or if the temperature is lowered to about 800° C., the combustion air is preheated by the regenerative bed 11 at a degree close to 800° C., permitting the air to be quickly ignited and burned with small amount of fuel. Thus, responsive to the heating temperature being raised or lowered, the combustion is immediately effected at the corresponding degree of temperature, while keeping lower the mount of fuel used.

In view of the above-noted advantages, it is readily possible to control the combustion amount of burners 9*a*, 9*a*-1, 9*b* . . . for each of the unit furnaces 2, independently of each other, so as to adjustably set a desired in-furnace temperature in each unit furnace 2, whereupon a desired in-furnace temperature pattern or gradient may be defined clearly within the entirety of steel heating furnace 1. During such temperature adjustment, a pressure in each unit furnace 2 is simultaneously controlled by operation of the furnace pressure control device 5 so as to stabilize the pressure throughout the furnace 1, thereby preventing the overflow of the combustion gas to the adjacent unit furnaces 2. Namely, the pressure per unit furnace 2 should be controlled within a given reference pressure degree by opening or closing the duct 7 for reducing or raising the in-furnace pressure.

It is noted that alternating the burner operation between the operative and inoperative states as stated above should be done at an interval of not more than 2 min. or not less than 20 sec., preferably at the interval of within about 1 min., or alternatively be done when the temperature of combustion gas reaches about 200° C.

Figure 5:
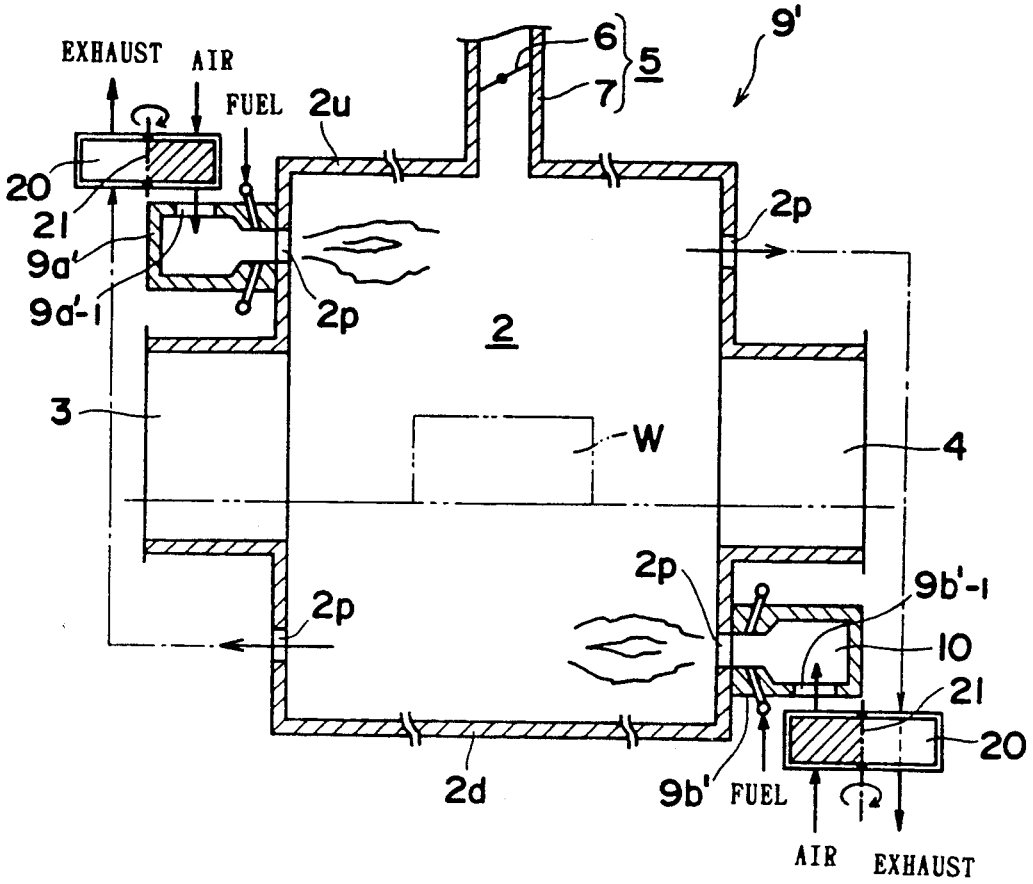
FIG. 5 is a schematic sectional view showing another embodiment of the burner system of regenerative heating type.
Figure 6:
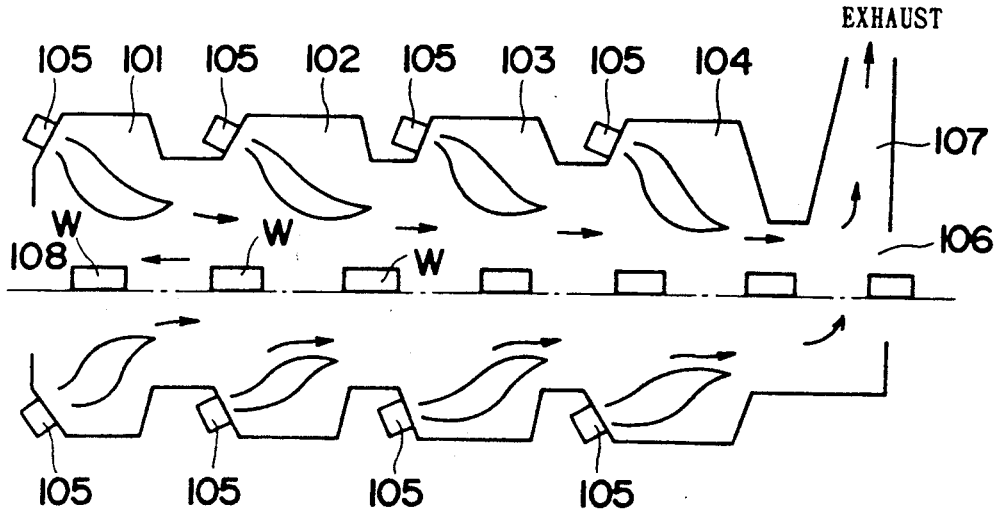
FIG. 6 (PRIOR ART)
FIG. 6 is a schematic view showing a steel heating furnace in the prior art.

FIG. 5 shows another mode of burner system 9' which employs a rotary disc-like regenerative bed 20 in the same unit furnace 2 as in the first embodiment above. In this second embodiment, the burner system 9' only includes one upper forward burner 9*a'* and one lower backward burner 9*b'*, as shown. Therefore, at the wall of unit furnace 2 opposite to the burner, there leaves the hole 2*p*, acting as a suction hole through which the combustion gas is sucked for exhaust out of the furnace. The disc-like regenerative bed 20 is provided rotatably adjacent to each of the two burners 9*a'*, 9*b'*, in such a manner that one half region of the bed 20 overlays the side of burner 9*a'* or 9*b'* in which a hole 9*a'*-1 is formed, while another half region thereof projects outwardly from the burner 9*a'* or 9*b'*. As indicated by the one-dot chain line in FIG. 5, there are provided a proper tubing and induced draft fan (not shown) for sucking and flowing the combustion gas towards the foregoing another half region of the regenerative bed 20, for the preheating purpose. After one stroke of combustion operation of the burners 9*a'*, 9*b'*, the projected half region of regenerative bed 20 received and stores an exhaust heat of the combustion gas, and is turned to the position overlaying the burner by rotation of the bed 20, so that, at next combustion stage, a combustion air is preheated by the bed 20 before being supplied into the burner body. In this way, it may be possible to switch over the relative flow of combustion air and combustion gas with respect to the regenerative bed 20.

Figure 7:
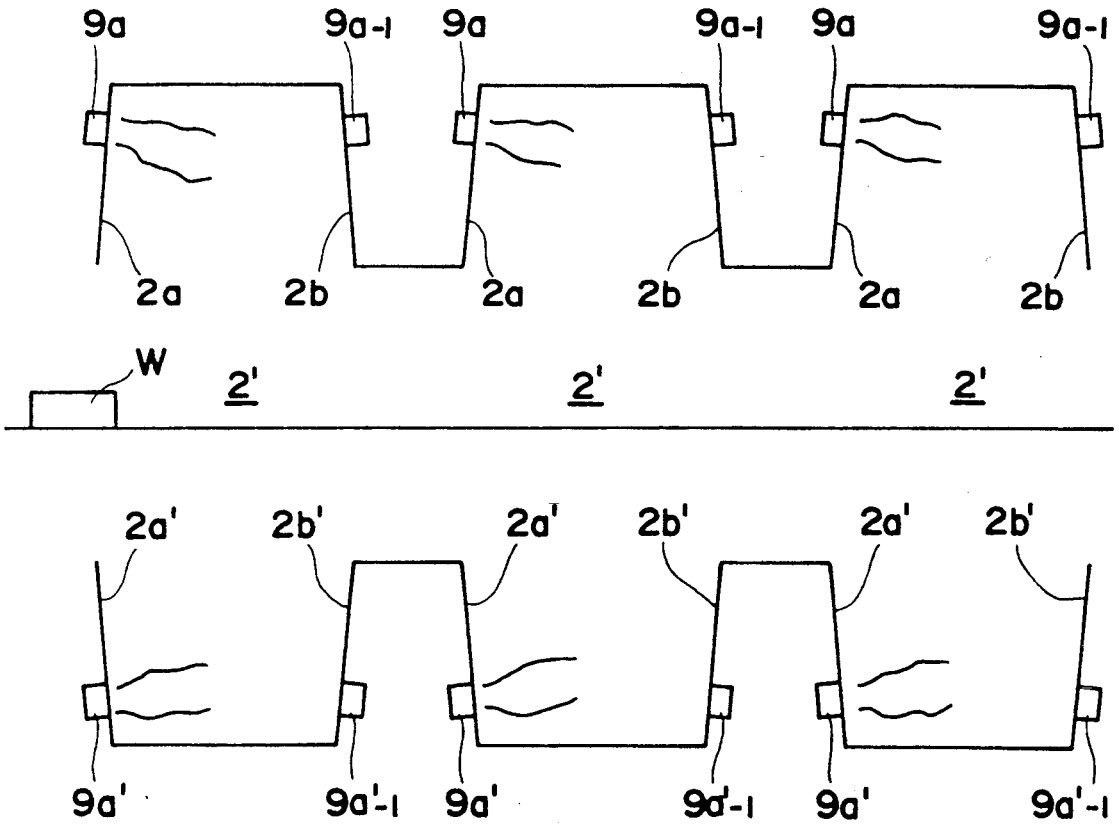
FIG. 7 is a schematic diagram showing another embodiment of the furnace

FIG. 7 shows another embodiment of unit furnace as designated by 2'. The unit furnaces 2 are each formed with a pair of upper partition walls 2*a*, 2*b* and a pair of lower partition walls 2*a'* and 2*b'*. All the partition walls 2*a*, 2*b*, 2*a'* and 2*b'* are intended to definitely isolate the unit furnaces from the another, thereby insuring to prevent any accidental overflow of combustion gas in one unit furnace 2' to the other adjoining ones 2'.

While having described the present invention so far, it should be understood that the invention is not limited to the illustrated embodiments but any other modifications may be applied structurally thereto without departing from the scope of the appended claims. For examples, the present burner system of regenerative heating type can freely be set in any desired positions and the number of burners may depend on a certain conditions. The present invention is practicable insofar as at least one pair of burners 9*a*, 9*a*-1 are installed in each unit furnace 2. Further, though not shown, auxiliary burners may be provided in the furnace wall, or regenerative-heating-type burners may be provided in the lateral wall of furnace to constitute a side-firing-type furnace. The furnace pressure control devices 5 may not be coupled to the collective smokestack 8 but may each be provided with its own smokestack, and may be operated independently of each other for adjustment of the in-furnace pressure.

In addition, though not shown, the present invention may comprise a single furnace of a sufficient length to complete a required heating process, and plural partition walls formed in the furnace in a manner dependent from the ceiling portion thereof so as to partition the inside of furnace into plural zones. At least one or more, or preferably two or more burner systems of regenerative heating type as mentioned above may be disposed in each zone of such single furnace for the alternating burner operations. Further, a proper furnace pressure control device, such as the one 5, is provided in each zone to allow direct exhaust of combustion gas for effective adjustment of in-furnace pressure.

Additionally, although the illustrated embodiment uses the four-way valve 14 as flow passage changeover means for selectively connecting the combustion air supply system 12 and the exhaust system 13 to the regenerative bed 11, the present invention is not particularly limited to that construction and may adopt any other suitable flow passage changeover means such as a flow passage changeover valve of spool type.

What is claimed is:

1. A continuous steel heating furnace through which workpieces move and are to be heated continuously, comprising:

a plurality of temperature zones defined in a direction in which the workpieces move in the furnace; and at least one pair of regenerative burner systems provided at each of said plurality of temperature zones, each said at least one pair of regenerative burner systems including:

a regenerative bed;

burner means;

combustion air supply means for supplying a combustion air via said regenerative bed to said burner means;

combustion gas exhaust means for exhausting a combustion gas via said regenerative bed from said burner means; and switch-over means for effecting a relative switch-over of a flow of said combustion air and a flow of said combustion gas with respect to said regenerative bed;

wherein a combustion amount in each of said plurality of temperature zones is controlled by means of said at least one pair of regenerative burner systems so as to adjustably set temperatures respectively in said temperature zones to selected degrees, independently of one another, whereby a desired temperature pattern is defined in said furnace to permit heating of the workpieces in each of said plurality of temperature zones to an optimal temperature.

2. A furnace according to claim 1, including:

means defining an entry opening in said furnace, through which workpieces enter said furnace; and means defining an exit opening in said furnace, through which workpieces leave said furnace;

said at least one pair of regenerative burner systems being controlled in the respective said plurality of temperature zones so that temperature in one of said plurality zones which is adjacent said entry opening is higher than a temperature in another of said plurality of temperature zones which is adjacent said exit opening.

3. A furnace according to claim 1, wherein said furnace is formed with a plurality of partition walls therein, said plurality of partition walls extending inwardly, and positioned to define said plurality of temperature zones, respectively.

4. A furnace according to claim 1, wherein said burner means comprises at least one burner, and there is provided a means for displacing said regenerative bed with respect to a flow of said combustion air and gas toward said burner.

5. A steel heating furnace according to claim 1, wherein said burner means comprises at least a pair of first burners and at least a pair of second burners such that said pair of first and second burners are disposed in a spaced-apart and opposed relation with one another.

6. A furnace according to claim 1, wherein each of said zones is provided with a furnace pressure control means for adjustment of an in-furnace pressure.

7. A continuous steel heating furnace in which workpieces are to be heated continuously, comprising:

one furnace body;

an entry opening defined in said furnace body, through which said workpieces are carried into said furnace body;

an exit opening defined in said furnace body, through which said workpieces are carried out of said furnace body;

said furnace body including a plurality of unit furnaces which define a plurality of temperature zones, respectively, extending in a direction in which the workpieces are carried in said furnace body;

at least one pair of regenerative burner systems provided at each of said plurality of unit furnaces each said at least one pair of regenerative burner systems including:

a regenerative bed;

burner means;

combustion air supply means for supplying a combustion air via said regenerative bed to said burner means;

combustion gas exhaust means for exhausting a combustion gas via said regenerative bed from said burner means; and switch-over means for effecting a relative switch-over of a flow of said combustion air and a flow of said combustion gas with respect to said regenerative bed;

wherein combustion in each of said plurality of temperature zones is controlled by means of said at least one pair of regenerative burner systems so as to adjustably set temperatures respectively in said temperature zones to selected degrees, independently of one another, whereby a desired temperature pattern is defined in said furnace to permit heating workpieces in each of said plurality of temperature zones to an optimal temperature.

8. A furnace according to claim 7, wherein said at least one pair of regenerative burner systems are so controlled in the respective said plurality of temperature zones that a temperature in one of said plurality of temperature zones, which is adjacent said entry opening, is higher than a temperature in another of said plurality of temperature zones which is adjacent said exit opening.

9. A furnace according to claim 7, wherein said unit furnaces is formed with at least one partition wall therein, such that said partition wall is dependent inwardly of and from said furnace body, to thereby define said plurality of temperature zones, respectively.

10. A furnace according to claim 7, wherein said burner means comprises at least one burner, and there is provided a means for displacing said regenerative bed with respect to a flow of said combustion air and gas toward said burner.

11. A furnace according to claim 1, wherein said burner system comprises two units of regenerative beds and burner means, which are integrally assembled as a pair, for each unit and said burner means in said two units are alternately brought into combustion for a short period of time.

12. A furnace according to claim 7, wherein said burner system comprises two units of regenerative beds and burner means, which are integrally assembled as a pair, for each unit and said burner means in said two units are alternately brought into combustion for a short period of time.

13. A furnace according to claim 7, wherein said burner means comprises at least a pair of first burners and at least a pair of second burners such that said pair of first and second burners are each disposed in a spaced-apart and opposed relation with other.

14. A furnace according to claim 7, wherein each of said unit furnaces is provided with a furnace pressure control means for adjustment of an in-furnace pressure.

15. A furnace according to claim 11, wherein each of said two units of regenerative beds and burner means contains an adjoining pair of said regenerative beds and burner means, said furnace including tubing arranged between each of the adjoining pairs of said regenerative beds and burner means for communicating said adjoining pairs of said regenerative beds and burner means with each other.

16. A furnace according to claim 15, wherein each temperature zone has an upstream side and a downstream side, one of said two units with its combustion air supply means, combustion gas exhaust means and tubing, being on the upstream side and the other of said two units with its combustion air supply means, combustion gas exhaust means and tubing, being on the downstream side.

17. A furnace according to claim 16, wherein said two units of regenerative beds and burner means comprise respective upper forward and upper backward regenerative beds and burner means, said burner system including two additional units of regenerative beds and burner means on respective upstream and downstream sides of each temperature zone, forming respective lower forward and lower backward regenerative beds and burner means.

18. A furnace according to claim 12, wherein, in said two units of regenerative beds and burner means, tubing is arranged between adjoining pairs of said regenerative beds and burner means for communicating said adjoining pairs of said regenerative beds and burner means with each other.

19. A furnace according to claim 18, wherein each temperature zone has an upstream side and a downstream side, one of said two units with its combustion air supply means, combustion gas exhaust means and tubing, being on the upstream side and the other of said two units with its combustion air supply means, combustion gas exhaust means and tubing, being on the downstream side.

20. A furnace according to claim 19, wherein said two units of regenerative beds and burner means comprise respective upper forward and upper backward regenerative beds and burner means, said burner system including two additional units of regenerative beds and burner means on respective upstream and downstream sides of each temperature zone, forming respective lower forward and lower backward regenerative beds and burner means.

* * * * *